US006480728B1

(12) United States Patent
Mansour

(10) Patent No.: US 6,480,728 B1
(45) Date of Patent: Nov. 12, 2002

(54) SUPERCONDUCTIVE NON-LINEAR TRANSMISSION LINES AND METHOD OF CONSTRUCTION

(75) Inventor: Raafat R. Mansour, Waterloo (CA)

(73) Assignee: Com Dev Ltd., Cambridge (CA)

( * ) Notice: Subject to any disclaimer, the term of this patent is extended or adjusted under 35 U.S.C. 154(b) by 0 days.

(21) Appl. No.: 09/459,617

(22) Filed: Dec. 13, 1999

(51) Int. Cl.[7] ..... H01P 3/08; H01B 12/02

(52) U.S. Cl. ..... 505/210; 333/20; 333/99.005; 505/700; 505/866

(58) Field of Search ..... 333/20, 995; 505/210, 505/700, 701, 866

(56) References Cited

U.S. PATENT DOCUMENTS 5,270,671 A * 12/1993 Waterman ..... 333/161
5,895,775 A * 4/1999 Shiau ..... 333/161 X

* cited by examiner

*Primary Examiner*—Benny T. Lee
(74) *Attorney, Agent, or Firm*—Daryl W. Schnurr

(57) ABSTRACT

A non-linear transmission line has high temperature superconductive elements periodically loaded thereon. The elements have non-linear characteristics that provide voltage dependent non-linearity to the transmission line. The line can have a circuit with a first layer and a second layer with the second layer having several interdigital circuits printed thereon. The line can also have a meandering configuration or a spiral configuration.

15 Claims, 7 Drawing Sheets

SUPERCONDUCTIVE NON-LINEAR TRANSMISSION LINES AND METHOD OF CONSTRUCTION

BACKGROUND OF THE INVENTION

1. Field of the Invention

The present invention relates to non-linear transmission lines and, more particularly, to the use of the inherent non-linearity characteristics of high temperature superconductive materials in the realization of non-linear transmission lines.

2 Description of the Prior Art

It is known that wave propagation on periodically-loaded Non-Linear Transmission Lines (NLTL) leads to the generation of harmonics, each of which travels at its own phase velocity. If non-linearity and dispersion are balanced, certain unique RF characteristics can be potentially achieved, such as shock wave formation and soliton propagation. Over the past years, several papers have been published on the use of periodically-loaded non-linear transmission lines in instrumentation and pulse compression applications. NLTL's are typically realized using a transmission line periodically loaded with varactor diodes. The non-linearity arises from the dependence of the capacitance of the varactor diodes on the voltage of the propagating wave along the transmission line.

There are other methods of achieving the required non-linearity and dispersion. For example, it has been suggested that loading a transmission line with non-linear dielectric materials can potentially lead to the realization of a NLTL (See D. Jäger, "characteristics of travelling waves along the non-linear transmission lines for monolithic integrated circuits: a review, "*Int. J. Electronics,*vol. 58, no. 4, pp. 649–669, 1995.).

NLTL's can be conveniently realized using Monolithic Microwave Integrated Circuits (MMIC) technology. The attenuation of these lines, however, considerably limits their usefulness in many applications. NLTL's can be also built using varactor diodes as discrete components attached to a transmission line. However, assembly of such Non-linear transmission lines is extremely difficult.

SUMMARY OF THE INVENTION

It is an object of the present invention to provide non-linear transmission lines using the high temperature superconductive technology and the non-linearity characteristics of such technology. It is a further object of the present invention to build non-linear transmission lines that have low insertion loss compared to what can be achieved using conventional MMIC technology.

A non-linear transmission line comprising a line extending between an input and an output, the line having high temperature superconductive elements periodically loaded thereon. Preferably, the elements have non-linear characteristics that provide voltage dependent non-linearity to the line.

A method of constructing a superconductive non-linear transmission line, the method comprising periodically loading HTS elements on a transmission line. Preferably, the HTS elements have non-linear characteristics that provide voltage dependent non-linearity to the line.

The foregoing and other objects and advantages of the invention will become apparent from the following description.

BRIEF DESCRIPTION OF THE DRAWINGS

In the description, reference is made to the accompanying drawings, which form a part hereof, and in which there is shown, by way of illustration, a preferred embodiment of the invention.

DESCRIPTION OF A PREFERRED EMBODIMENT

Figure 1:
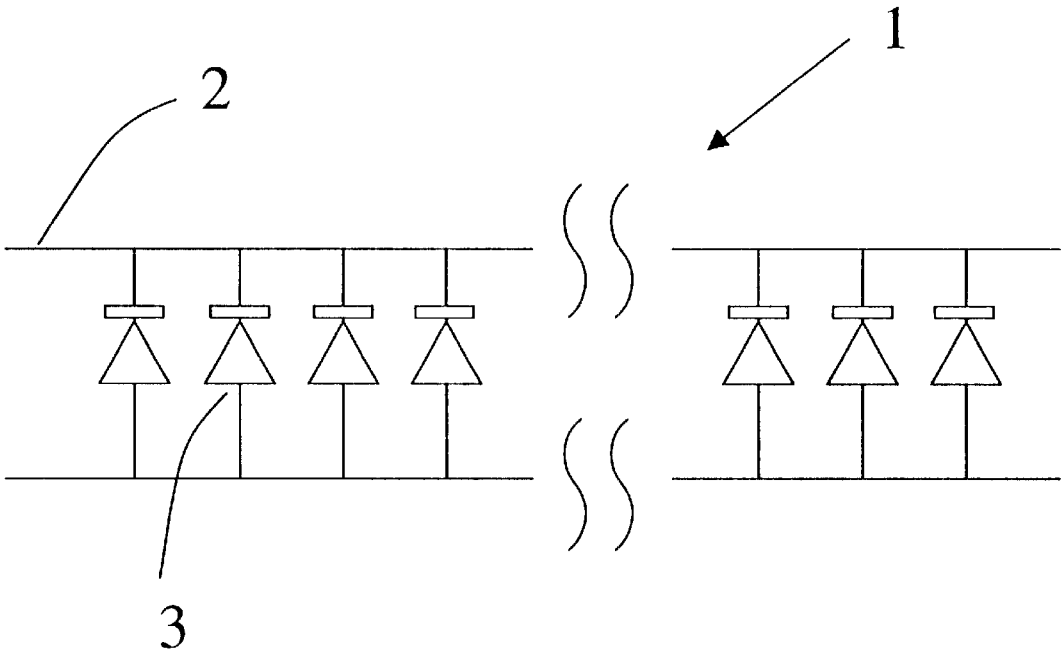
Figure 1 (prior art)
FIG. 1 is a top view of a typical prior art non-linear transmission line.
Figure 2:
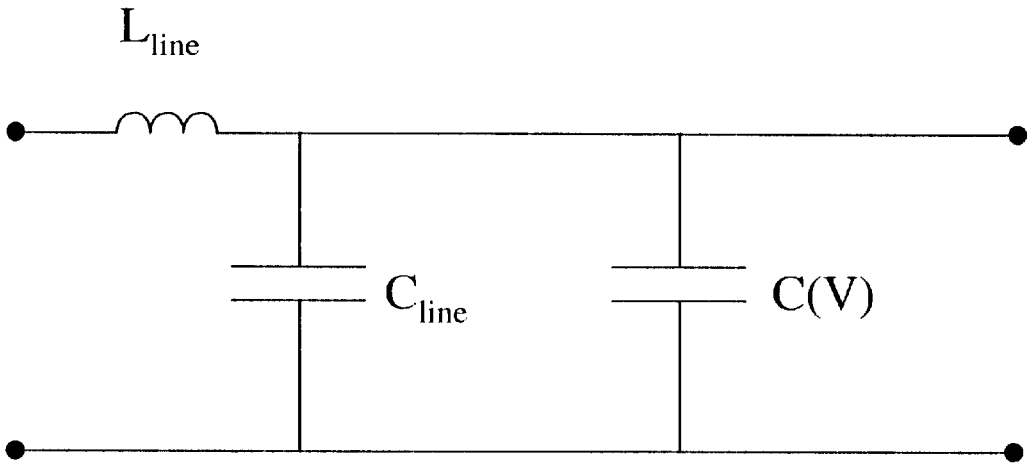
FIG. 2 is a prior art circuit illustrating the equivalent circuit of one section of the non-linear transmission line shown in FIG. 1.

FIG. 1 illustrates a conventional Non-Linear Transmission Line 1. It consists of a transmission line 2 periodically-loaded with varactor diodes 3. The equivalent circuit of a unit cell of the loaded line is shown in FIG. 2. The non-linearity is attributed to the voltage dependent capacitance of the C(V) varactor diodes while the dispersion results from the passband characteristics of the periodic structure. A series inductance $L_{Line}$ and a shunt capacitor $C_{Line}$ represent a small section of transmission line.

Figure 3:
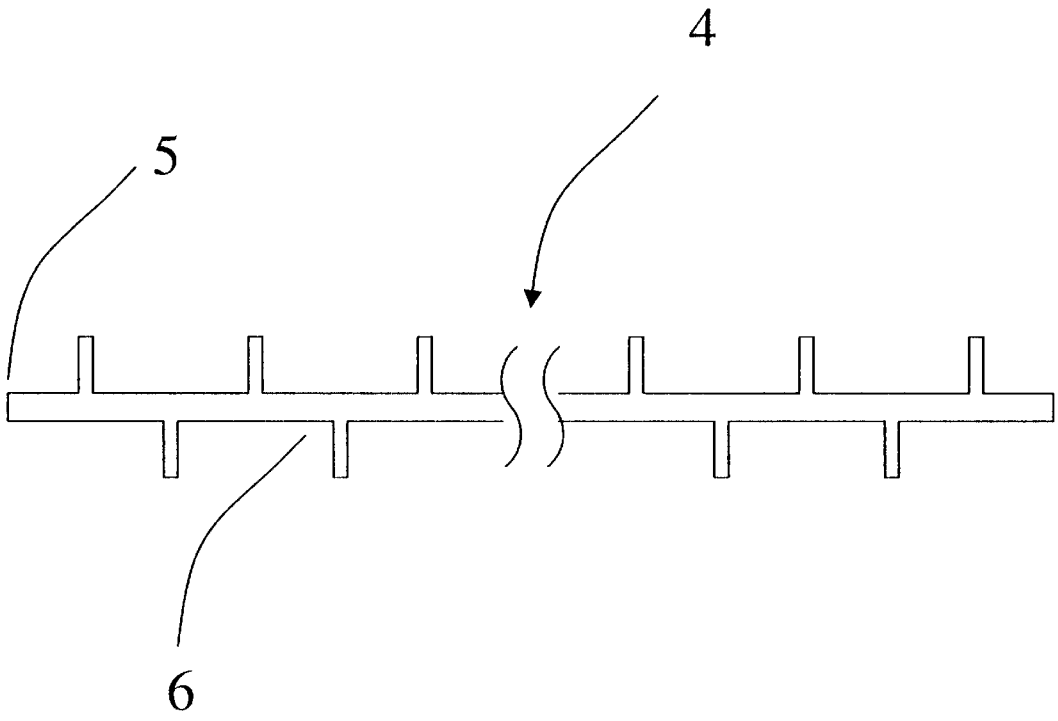
FIG. 3 is a top view of a superconductive non-linear transmission line according to an embodiment of the present invention.

FIG. 3 illustrates a preferred embodiment of the present invention. A circuit 4 consists of a transmission line 5 loaded with stubs 6 made of HTS materials. The width of the stubs is very small so that the stubs become non-linear at the operating power level. The transmission line 5 can be made of gold films, HTS films or HTS films coated with gold films on a substrate (not shown). If the transmission line 5 is made out of HTS films, its width must be wide enough to avoid non-linearity effects. It can be seen that the stubs are equidistant from one another along the transmission line 5.

Figure 4:
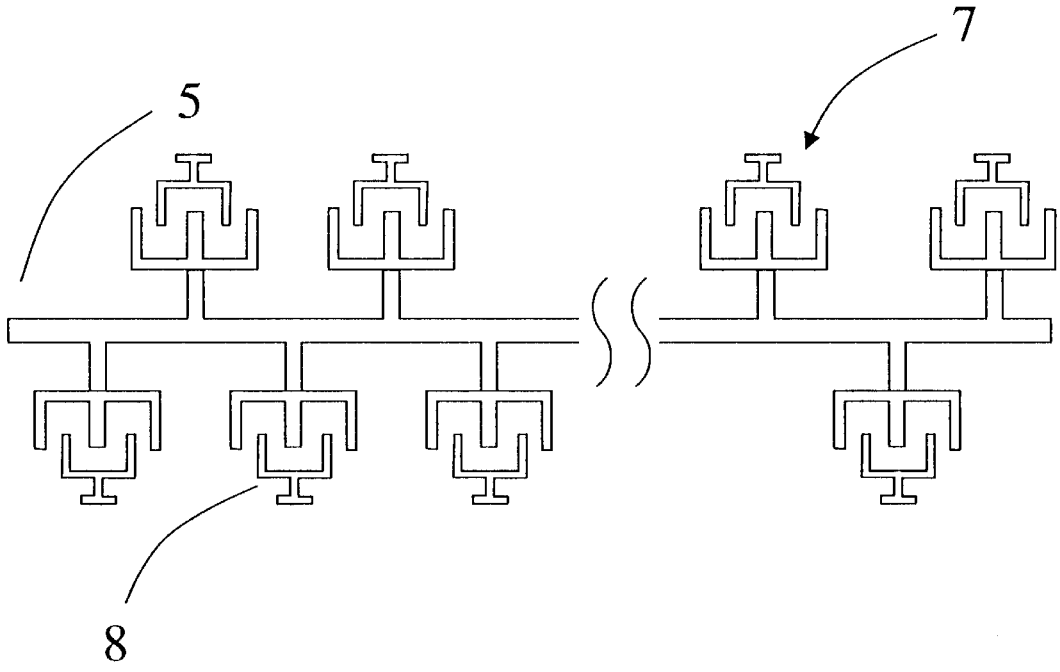
FIG. 4 is a view of a superconductive non-linear transmission line according to a further embodiment of the present invention.

In FIG. 4, there is shown a further preferred embodiment of the present invention. The circuit 7 consists of a transmission line 5 loaded with inter-digital capacitors 8 made out of HTS materials. The dimensions of the inter-digital capacitors are chosen such that the capacitors are nonlinear at the operating power level.

Figure 5:
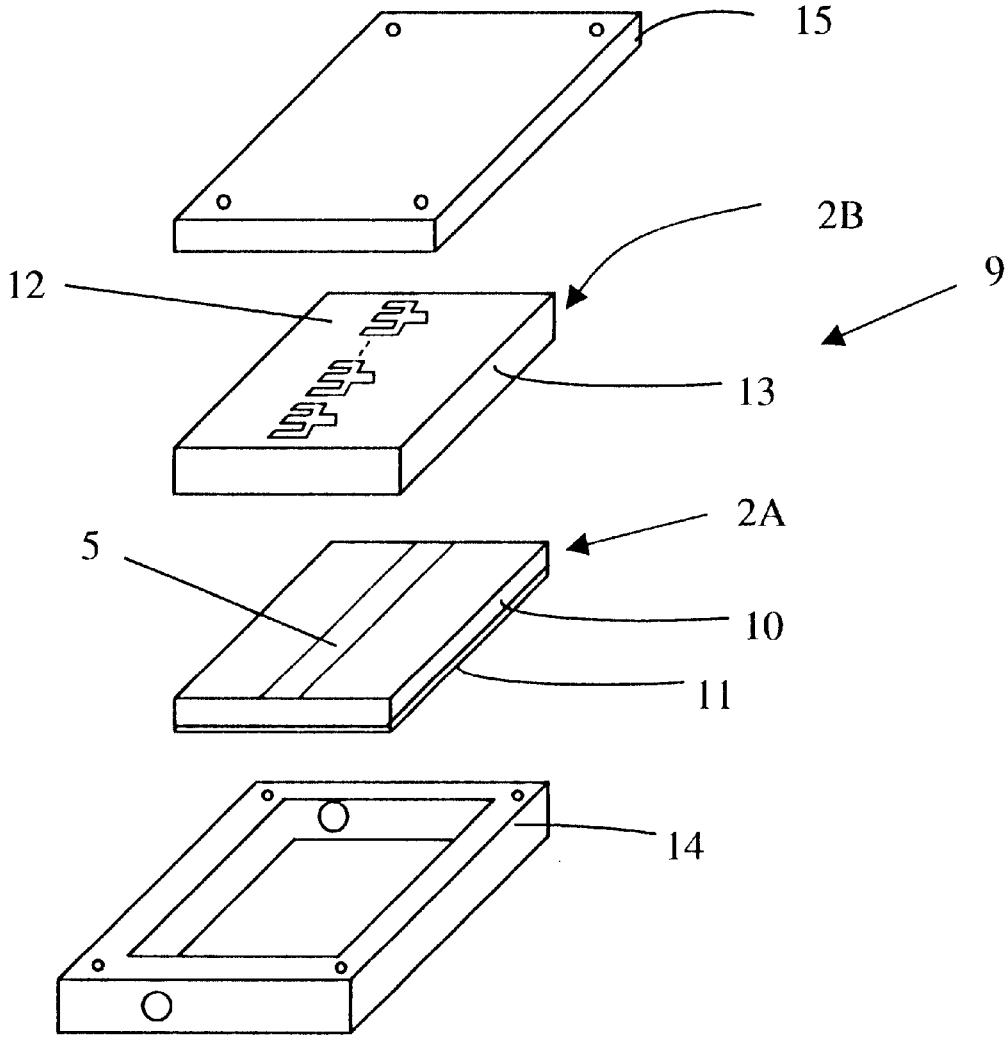
FIG. 5 is a view of a superconductive non-linear transmission line according to still a further embodiment of the present invention.

FIG. 5 shows a still further preferred embodiment of the present invention. A non-linear transmission line circuit 9 consists of two layers 2A and 2B. Layer 2A consists of a transmission line 5 printed on a substrate 10 attached to a ground plane 11 while layer 2B consists of several inter-digital circuits 12 printed on a substrate 13. The circuit 9 is assembled in a housing 14 by epoxying the ground plane 11 to the bottom of the housing 14. A plate 15 serves as a top cover. Layer 2B is placed on top of the layer 2A by using low loss adhesive or any other means. The dimensions of the HTS interdigital circuits 12 are chosen to be very thin to allow non-linearity to be generated. pg,5

Figure 6:
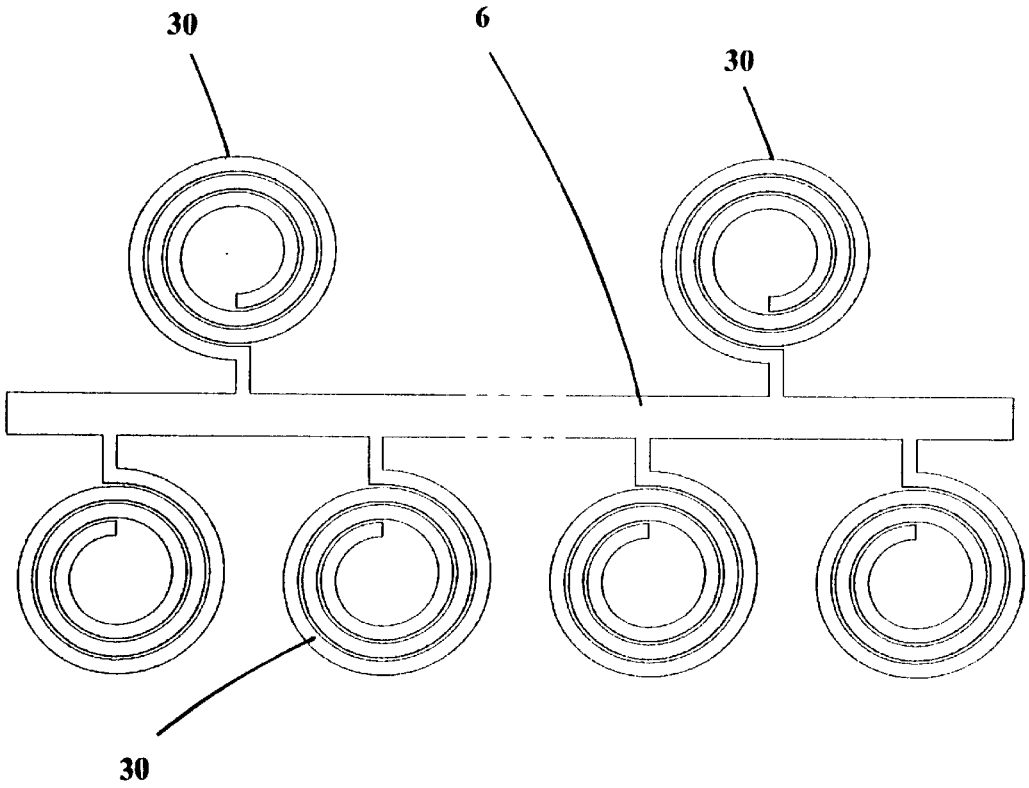
FIG. 6 is a schematic top view of a transmission line having spiral shaped elements.
Figure 7:
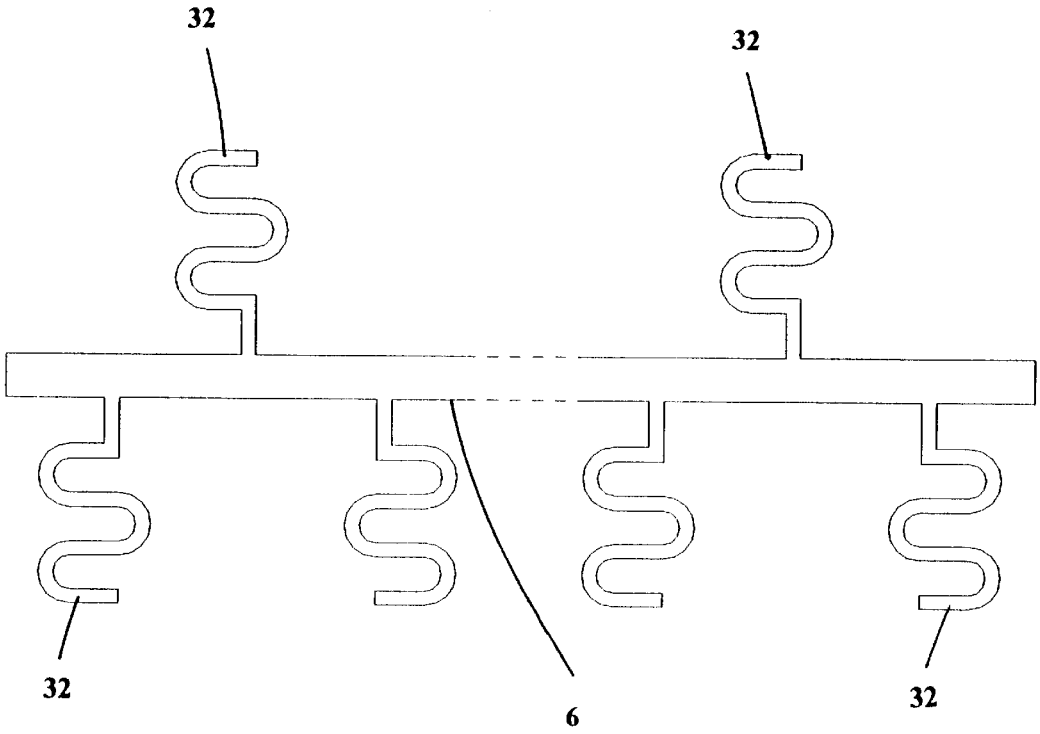
FIG. 7 is a schematic top view of a transmission line having meandering shaped elements.

In FIGS. 3, 4 and 5, the circuits are shown to be in the form of a "straight-line configuration". However, these circuits can be also in the form of a "spiral configuration" or "meander configuration" as shown in FIGS. and 7 respectively. In FIG. 6, a transmission line 6 has spiral elements 30 thereon to provide non-linearity to the main transmission line 6. In FIG. 7, meandering elements 32 provide non-linearity to the transmission line 6. The spiral and meander configurations allow the integration of a superconductive NLTL with a large number of non-linear elements on one wafer.

Preferably, the HTS elements are HTS films or stubs of HTS films that are narrow enough to become non-linear at the operating power level of the transmission line.

Superconductive, non-linear transmission lines, have an advantage in that they have a relatively low loss. Additionally, they can be easily fabricated since no varactor diode assembly is required.

Although the present invention has been fully described by way of example in connection with a preferred embodiment thereof, it should be noted that various changes and modifications will be apparent to those skilled in the art. Therefore unless otherwise such changes and modifications depart from the scope of the present invention, they should be construed as being included therein.

I claim:

1. A non-linear transmission line comprising a main transmission line extending between an input and an output, said main transmission line having high temperature superconductive elements periodically loaded thereon, said elements having non-linear characteristics and being equidistant from one another along said main transmission line.

2. A non-linear transmission line as claimed in claim 1 wherein said elements are constructed to provide voltage dependant non-linearity to said main transmission line.

3. A non-linear transmission line as claimed in claim 2 wherein said high temperature superconductive elements are selected from the group consisting of stubs comprised of high temperature superconductive material and inter-digital capacitors made from high temperature superconductive material.

4. A non-linear transmission line as claimed in claim 3 wherein the main transmission line is comprised of a material selected from the group consisting of gold film, high temperature superconductive film and high temperature superconductive film coated with gold film.

5. A non-linear transmission line as claimed in claim 4 wherein the main transmission line is comprised of high temperature superconductive film that is sufficiently wide to avoid non-linearity effects.

6. A non-linear transmission line as claimed in claim 1 wherein said main transmission line is provided by a circuit to define said periodically loaded superconductive elements having a first layer and a second layer, said first layer having said main transmission line printed thereon on a substrate attached to a ground plane, said second layer having several interdigital circuits printed thereon.

7. A non-linear transmission line as claimed in claim 6 wherein said interdigital circuits are thin in width to allow non-linearity to be generated.

8. A non-linear transmission line as claimed in claim 1 wherein said main transmission line is located on a substrate attached to a ground plane.

9. A non-linear transmission line as claimed in claim 1 wherein said main transmission line is enclosed in a housing.

10. A non-linear transmission line as claimed in claim 1 wherein said elements on said main transmission line have a spiral configuration.

11. A non-linear transmission line as claimed in claim 1 wherein said elements on said main transmission line have a meandering configuration.

12. A non-linear transmission line as claimed in claim 3 wherein said stubs are narrow in width to become non-linear at the operating power level of the main transmission line.

13. A method of constructing a superconductive non-linear transmission line comprising a main transmission line extending between an input and output, said method comprising periodically loading high temperature superconductive elements having non-linear characteristics on said main transmission line so that said elements are equidistant from one another.

14. A method as claimed in claim 13 including the step of periodically loading high temperature superconductive elements that have non-linear characteristics that provide voltage dependent non-linearity to said transmission line.

15. A method as described in claim 14 comprising the steps of choosing interdigital capacitors made from high temperature superconductive material as said elements, choosing dimensions for said capacitors so that said capacitors are non-linear at the operating level of said transmission line.

* * * * *